US006696793B2

(12) United States Patent
Yamashita

(10) Patent No.: US 6,696,793 B2
(45) Date of Patent: Feb. 24, 2004

(54) ION SOURCE

(75) Inventor: Takatoshi Yamashita, Kyoto (JP)

(73) Assignee: Nissin Electric Co., Ltd., Kyoto (JP)

( * ) Notice: Subject to any disclaimer, the term of this patent is extended or adjusted under 35 U.S.C. 154(b) by 0 days.

(21) Appl. No.: 10/294,813

(22) Filed: Nov. 15, 2002

(65) Prior Publication Data

US 2003/0094902 A1 May 22, 2003

(30) Foreign Application Priority Data

Nov. 16, 2001 (JP) ..... 2001-351649

(51) Int. Cl.[7] ..... H01J 27/00
(52) U.S. Cl. ..... 315/111.81; 250/423 R
(58) Field of Search ..... 250/423 R, 427; 315/111.81, 111.91, 111.71

(56) References Cited

U.S. PATENT DOCUMENTS 5,661,308 A * 8/1997 Benveniste et al. .... 250/492.21

FOREIGN PATENT DOCUMENTS

| | | |
|---|---|---|
| JP | 09-035648 | 2/1997 |
| JP | 9-129152 | 5/1997 |
| JP | 10-27553 | 1/1998 |
| JP | 2001 307650 | 11/2001 |

OTHER PUBLICATIONS

U.S. Patent Application Publication 2001/0017353 A1, Aug. 30, 2001, Application No. 09/773,664, filed Feb. 2, 2001.
UK Patent Search, Application No. GB 0226825.8, dated Jul. 29, 2003.

* cited by examiner

*Primary Examiner*—David Hung Vu
(74) *Attorney, Agent, or Firm*—Finnegan, Henderson, Farabow, Garrett, & Dunner LLP

(57) ABSTRACT

An ion source called as a Bernas-type ion source is additionally provided with a positive electrode and a bias power source. The positive electrode is provided in a plasma production chamber and is electrically isolated therefrom. The positive electrode has three openings at least at both sides of a X direction along a magnetic field produced in a magnetic field generator and at a side of an ion extraction opening (a side of ion beam extraction direction). The bias power source applies a positive bias voltage to the positive electrode and to the plasma production chamber. With combination of constituent elements, the positive electrode serves to push back the ion in the plasma and further functions to suck a secondary electron in the plasma, thereby increase the rate of the multiply charged ion in the plasma.

6 Claims, 4 Drawing Sheets

ION SOURCE

BACKGROUND OF THE INVENTION

1. Field of the Invention

The present invention relates to an ion source of an electronic impact type for producing plasma by ionizing a gas by electronic impact in a magnetic field. More particularly, the present invention relates to an ion source which can increase the rate of multiply charged ion (ion of doubly charged or more) contained in an ion beam to be extracted.

2. Description of the Related Art

There are various systems of the ion sources of the electronic impact type. One of the examples is disclosed in Patent Laid Open 35648/1997, where an ion source of a Bernas-type is described for increasing the density of plasma by using in combination of confinement of electron by a magnetic field and reflection of electron by a reflector.

It has been demanded to extract the multiply charged ion, that is, ion of doubly charged or more, from the ion source for utilizing the same. This is because, in comparison with singly charged ion, the multiply charged ion enables to obtain an accelerating energy of times of the charged number (for example, in a case of doubly charged ion, two times,) at the same acceleration voltage, and thus the multiply charged ion may be easily converted to a high energy. In order to produce much multiply charged ion in this type of ion source, it is usually necessary to increase an average electronic energy in plasma. Therefore, the following measures have been attempted: (a) a magnetic field for confining electron is intensified, (b) a density of plasma is increased, or (c) an energy of primary electron from the electron producing source is increased.

The electron in plasma is composed of a primary electron (the energy is normally about tens of eV to hundreds of eV) from the electron producing source and a secondary electron (the energy is normally about several eV to tens of eV) released at the time of ionization of the primary electron which is in collision with a neutral gas. An electron (third electron and the following electrons) released at the time of collision of the secondary electron with the neutral gas is called as secondary electron inclusively in the specification.

Since the electron of high energy is needed to produce multiply charged ion (for example, more than tens of eV are needed for producing doubly charged ion), the secondary electron is scarcely contributive to produce multiply charged ion. The multiply charged ion is almost produced by the primary electron. In contrast, for producing a singly charged ion, the electron energy as high as the case of the multiply charged ion is not required, and so the secondary electron is much contributive to produce singly charged ion.

However, each of the measures shown in (a) to (c) allows much of the secondary electron as well as the primary electron to be produced. That is, in case multiply charged ion is much produced, the singly charged ion is produced much as well. Therefore, the rate of multiply charged ion contained in the ion beam to be extracted from the ion source is hardly increased.

Therefore, in order to increase the quantity of multiply charged ion beam, the whole ion beam current is inevitably increased. However, in case the whole ion beam current is increased so much, an electrode system for extracting the ion beam will cause troubles including beam current limitation owing to a space charge effect or occurrence such as discharge between electrodes. Further, although electric current applied to the power source for supplying an extraction voltage to the extraction electrode system becomes large, it is difficult to supply a large electric current in view of capacity of the extraction power source. Therefore, a limitation is present to increase the whole beam current, and it is difficult to increase the quantity of the multiply charged ion taking such measures.

SUMMARY OF THE INVENTION

It is an object of the invention to provide an ion source which can increase the rate of the multiply charged ion contained in plasma, and also in the ion beam, thereby to increase the quantity of the multiply charged ion to be extracted.

In order to accomplish the object above, the following means are adopted. According to the present invention, there is provided an ion source comprising:

- a plasma production chamber having a gas introduction portion for introducing a gas into the plasma production chamber, and an ion extraction opening for extracting ion beam thereat;
- an electron producing source for supplying electron into the plasma production chamber to ionize the gas by electronic collision, thereby to produce plasma;
- a magnetic field generator for producing a magnetic field for confining the electron produced at the electron producing source within the plasma production chamber;
- a positive electrode provided in the plasma production chamber as electrically isolated therefrom, and having three openings formed at least at both sides in a direction along the magnetic field and at a side of the ion extraction opening; and
- a direct current bias power source for applying bias voltage to the positive electrode, the bias voltage being positive against the plasma production chamber.

Main working effects obtained by providing the positive electrode and the bias power source are following (1) and (2).

(1) Ion Pushing-Back Action by the Positive Electrode

The ion in plasma produced in the plasma production chamber is pushed back toward the plasma, because the ion in plasma has the same polarity as the positive electrode, by the positive bias voltage applied to the positive electrode, in the wall surfaces other than the opening of the positive electrode. The pushed back ion is subject to collision by the primary electron produced mainly in the electron producing source, so that the charged number is increased. Generally as to the rate of the ion producing possibility of n charged ($n \geqq 2$) ion, compared to (a) the possibility to produce the n charged ion from a neutral gas, (b) the possibility to produce the n charged ion from an n−1 charged ion is by far large. According to the ion source, since the process of (b) may be efficiently utilized by use of the pushed-back ion (namely, what is already ionized), the multiply charged ion may be efficiently produced.

(2) Absorption of the Secondary Electron by the Positive Electrode

The primary electron produced in the electron producing source is trapped by a magnetic field produced by the magnetic field generator and is moved following the magnetic field. In the moving process, the primary electron comes in collision with a neutral gas to produce the plasma. Since the primary electron has a comparatively high energy as above described, this contributes to production of the singly charged ion and the multiply charged ion.

In the neighborhood of the thus produced plasma, there is the positive electrode to be applied with the positive bias voltage from the bias power source. The secondary electron released at the time of collision of the primary electron with the neutral gas has the comparatively low energy as above mentioned and is released indefinitely in many directions. Thus, owing to existence of the positive electrode in the neighborhood of the plasma, the secondary electron in the neighborhood of the positive electrode is absorbed by the positive electrode of different polarity. The quantity of the secondary electron existing in the plasma is reduced as well accordingly. Incidentally, since the primary electron produced from the electron producing source has a comparatively high directivity and is trapped by the magnetic field to move along the magnetic field, the rate of the primary electron absorbed by the positive electrode is far smaller than the secondary electron. In order to further reduce the rate of the primary electron absorbed by the positive electrode, it is preferred to more intensify the magnetic field produced by the magnetic field generator so as to cause the magnetic field to intensively trap the primary electron.

Since the secondary electron has the comparatively small energy as above described, it scarcely contributes to the production of the multiply charged ion, but contributes only to the production of the singly charged ion. Since the quantity of the secondary electron is reduced owing to the existence of the positive electrode, the singly charged ion produced in the plasma will be reduced correspondingly. Viewing it differently, the rate of the multiply charged ion in the plasma is relatively increased.

With the actions of the preceding (1) and (2), the rate of the multiply charged ion in the plasma may be increased, and in turn the rate of the multiply charged ion contained in the ion beam may be increased. As a result, the quantity of the multiply charged ion to be extracted may be increased without totally increasing the ion beam current (ion beam extraction quantity).

DETAILED DESCRIPTION OF THE INVENTION

Figure 1:
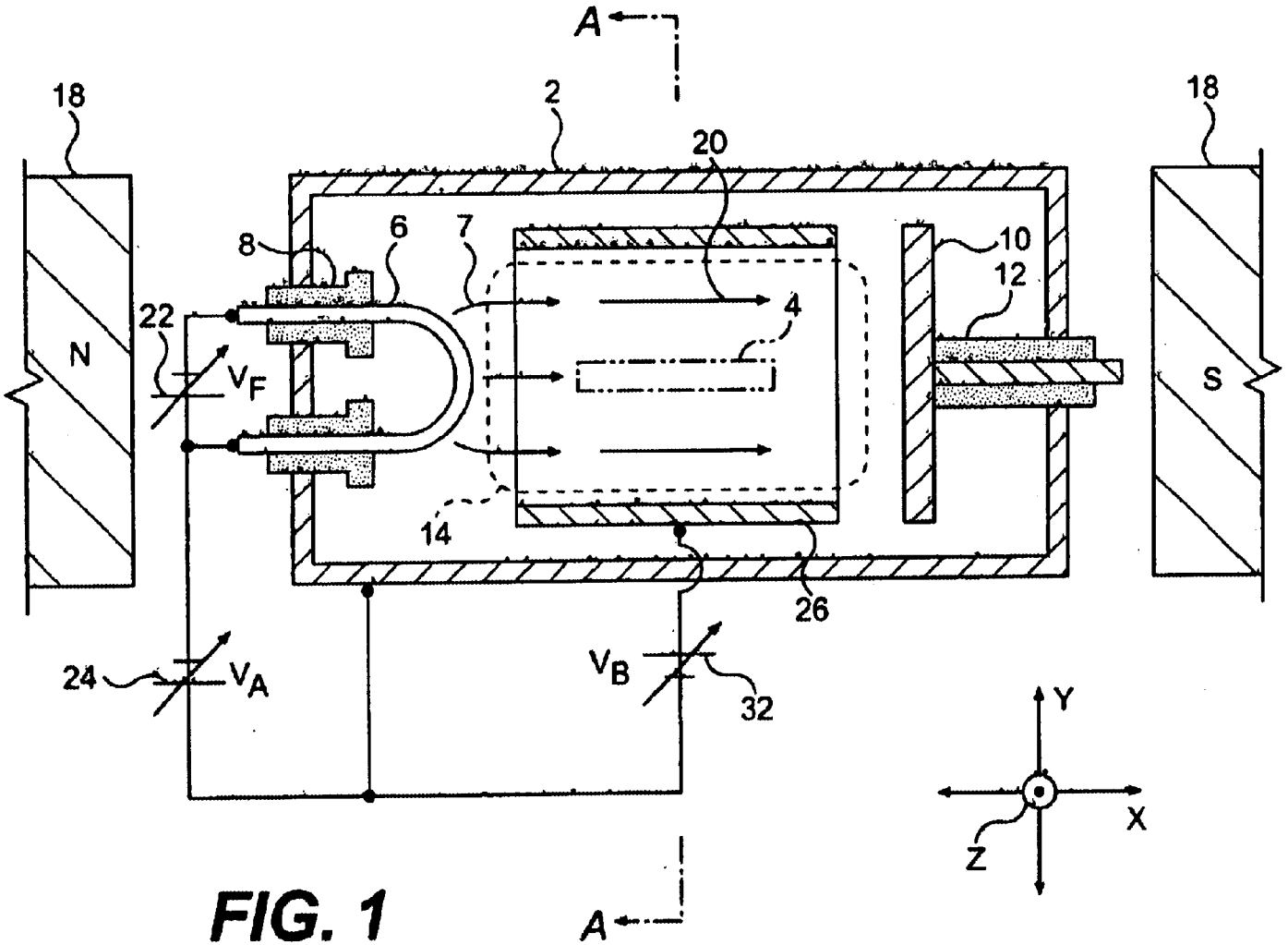
FIG. 1 is a cross sectional view showing one example of an ion source of the invention.
Figure 2:
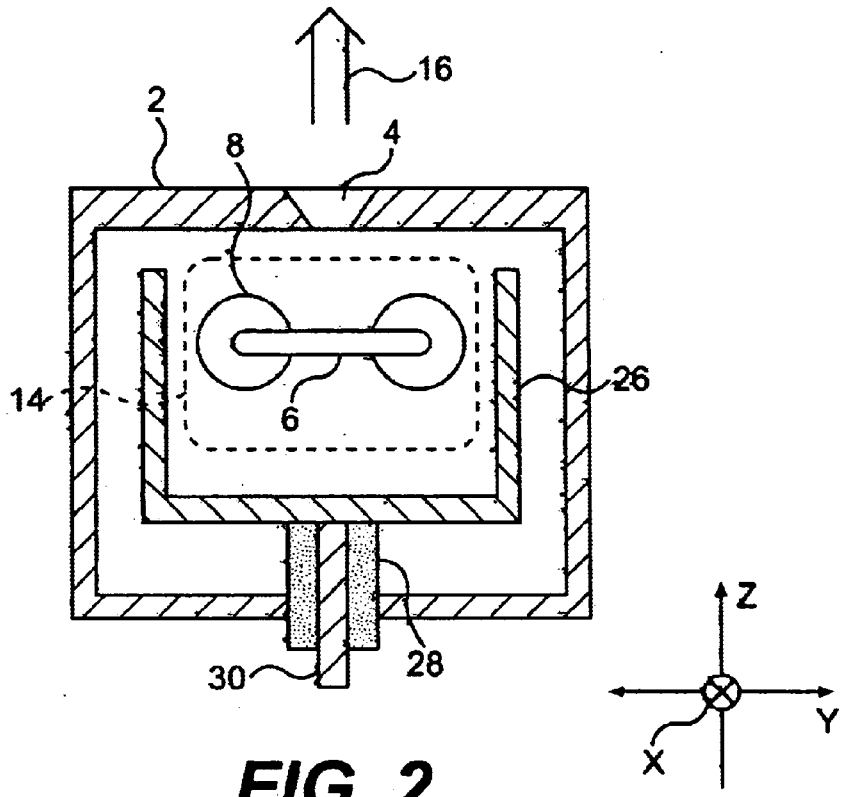
FIG. 2 is an enlarged cross sectional view taken along the line A—A of FIG. 1.
Figure 3:
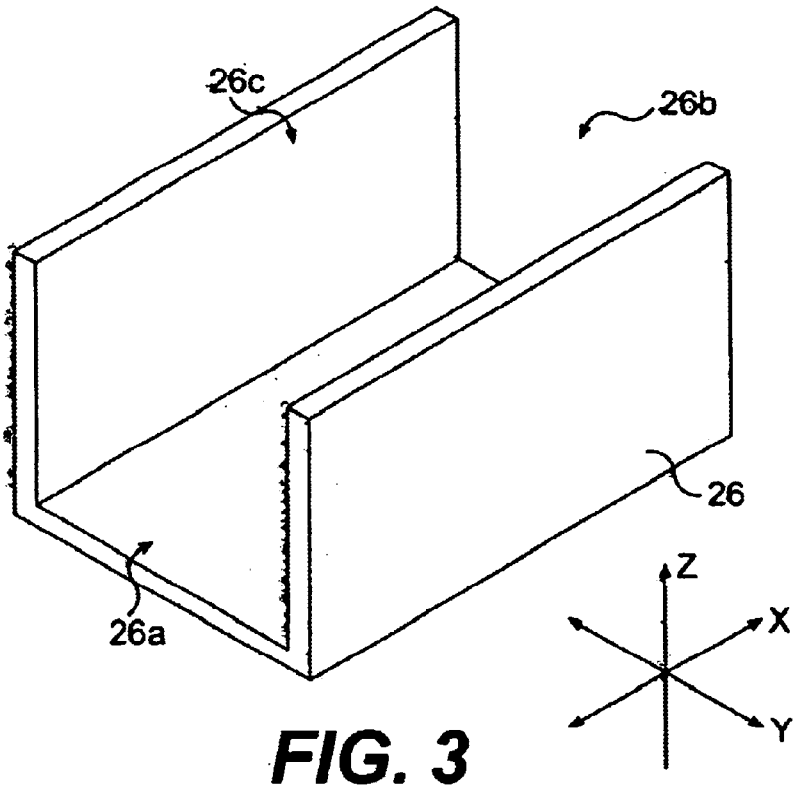
FIG. 3 is a perspective view of a positive electrode of FIG. 1.

FIG. 1 is a cross sectional view showing one example of an ion source of the invention. FIG. 2 is an enlarged cross sectional view taken along the line A—A of FIG. 1. FIG. 3 is a perspective view of a positive electrode of FIG. 1.

An ion source of the invention is characterized by adding a positive electrode 26 and a bias power source 32 to what is generally known as Bernas-type ion source.

The ion source includes, for example, a rectangular parallelepiped-shaped plasma production chamber 2 serving as a positive electrode. A gas (including vapor) for producing the plasma 14 is introduced into the plasma production chamber 2. The plasma production chamber 2 has an opening 4 for extracting the ion beam 16 at a wall surface of a Z direction (or a direction to which the ion beam is extracted) side (long side wall) thereof. The ion extraction opening 4 is, for example, slit shaped.

Inside one of the wall surfaces (short side walls) provided at both sides in an X direction crossing with the ion beam extraction direction Z of the plasma production chamber 2, there is provided a filament 6 in U-shape in this embodiment as an electron producing source. The electron producing source is used to supply electron 7 (primary electron) into the plasma production chamber 2 so as to ionize the gas by way of electronic impact, thereby to produce plasma 14. The filament 6 and the plasma production chamber 2 are electrically isolated from each other by isolators 8. The direction crossing with the directions X and Z is Y-direction.

Inside the other of the wall surfaces (short side walls) provided at both sides in the direction X of the plasma production chamber 2, there is provided a reflector 10 which is positioned opposite to the filament 6 to reflect the primary electron 7 in the opposite direction. The reflector 10 and the plasma production chamber 2 are electrically isolated from each other by an isolator 12. The reflector 10 may be connected to nothing else so as to be a floating electric potential as shown in this embodiment or may be connected to one end of the filament 6 (for example, the positive potential terminal of a filament power source 22) so as to be a filament electric potential.

Outside the plasma production chamber 2, there are provided a magnetic field generator 18 placed on both sides of the plasma production chamber 2 in the direction X. The magnetic field generator 18 produces a magnetic field 20 in the direction X in the plasma production chamber 2 for trapping the primary electron 7 produced at the filament 6 and increasing efficiency of producing and maintaining the plasma 14. In short, the magnetic field 20 is produced in the direction X connecting the filament 6 and the reflector 10. The magnetic field 20 may be directed in opposition to the example as shown. The magnetic field generator 18 may be, for example, electromagnet. The intensity of the magnetic field 20 in the plasma production chamber 2 is preferred to be high in the ion source of the present invention, preferably, for example, 10 mT to 50 mT.

The filament 6 has a direct current filament voltage $V_F$ (for example, 2 to 4V) applied thereto from a direct current filament power source 22 so as to heat the filament 6 and emit the primary electron 7 from the filament 6.

For the purpose of causing an arc discharge between the filament 6 and the plasma production chamber 2, an arc voltage $V_A$ (for example, 40 to 100 V) is applied between one end of the filament 6 and the plasma production chamber 2 from a direct current arc source 24 while the filament 6 is converted to a negative side.

In addition to the above mentioned structure, the ion source is further provided with a positive electrode 26 and a bias power source 32.

The positive electrode 26 is provided in the plasma production chamber 2 and is electrically isolated therefrom. The positive electrode 26 is, for example, tube, box or trough shaped with a square in cross section along the plane Y-Z, and has openings 26*a* to 26*c* located at 3 places (FIG. 3) in total at least at both sides in the direction (X-direction) along the magnetic field 20 and at the side of the ion extraction opening 4 (the side of ion beam extraction direction Z). More specifically, the positive electrode 26 opens at 3 sides in total in this the example, namely on both sides thereof in the direction X and on one side in the direction Z, and is tube, box or trough shaped, with a square in cross section along the plane Y-Z. The positive electrode 26 is supported by the plasma production chamber 2 and is electrically isolated therefrom by an isolator 28.

The positive electrode 26 having the openings 26*a* to 26*c* does not disturb the movement of the primary electron 7 produced from the filament 6 and the extraction of the ion beam 16 from the plasma 14. Namely, the primary electron 7 released from the filament 6 may be reciprocally moved along the magnetic field 20 between the filament 6 and the reflector 10 through the openings 26*a* and 26*b* located in the direction X, and thereby the plasma 14 may be efficiently produced. Further, since the plasma 14 may be diffused nearly to the neighborhood of the ion extraction opening 4 through the opening 26*c* provided at the side of the ion extraction opening 4, the ion beam 16 may be efficiently extracted from the plasma 14 through the ion extraction opening 4.

The bias power source 32 is a direct current power source for applying the bias voltage $V_B$ to the positive electrode 26, said bias voltage being positive to the plasma production chamber 2 (namely, on the basis of a reference of the potential of the plasma production chamber 2). According to the embodiment, the bias voltage $V_B$ is applied to the positive electrodes 26 through an electrically conductive member 30 (FIG. 2). The degree of the bias voltage $V_B$ is not specifically limited, but is preferably up to 500 V because a voltage which is too high makes the electric isolation difficult by way of the isolator 28, and a lowest voltage is 1 V. Therefore, the degree of the bias voltage $V_B$ may be preferable within 1 V to 500 V.

Figure 4:
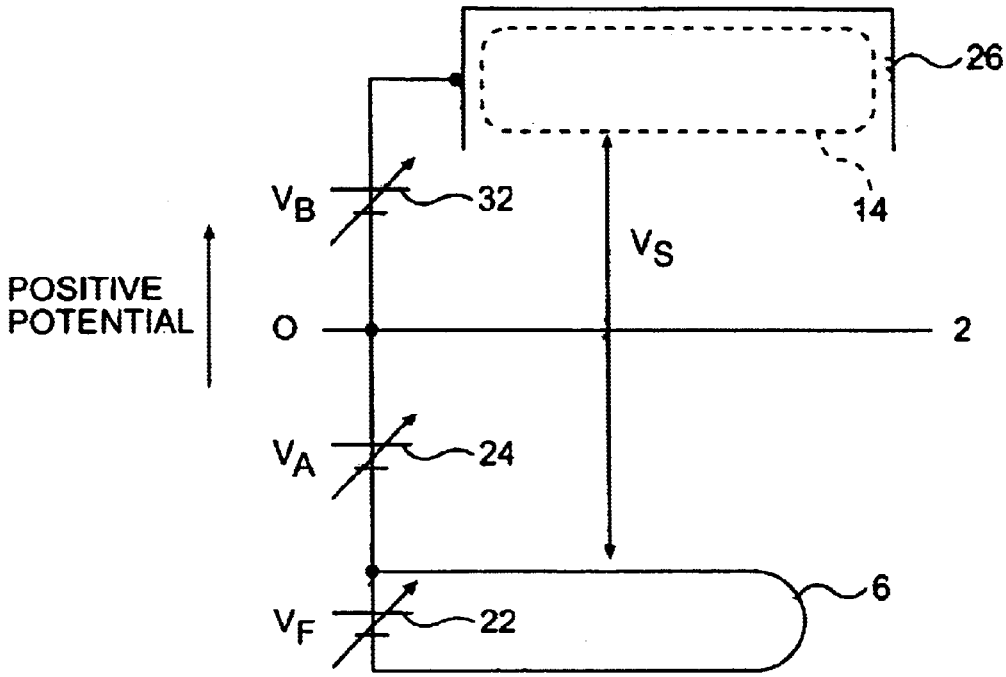
FIG. 4 is a view schematically showing the arrangement of an electric potential in the ion source of FIG. 1.

FIG. 4 schematically shows one example of a potential arrangement in the ion source. With the positive electrode 26 provided to have the bias voltage $V_B$ applied thereto in the plasma production chamber 2, the potential of the plasma 14 comes to be a potential approximately corresponding to the bias voltage $V_B$. This is because the plasma has a property where a plasma potential comes near to a potential of electric conductor of a highest potential which is near to the plasma, and because the electric conductor is the positive electrode 26 in this example.

Therefore, in the ion source, the substantial arc voltage $V_S$ is represented by the following formula in case the orientation of the arc voltage $V_A$ is positive on the side of the plasma production chamber 2 as shown. Substantial arc voltage $V_S$ is a voltage for deciding the energy of the electron 7 which is emitted from the filament 6, and becomes the arc voltage $V_A$ in the case of the known ion source having neither positive electrode 26 nor bias electric power 32. Incidentally, the filament voltage $V_F$ is neglected here because this is small.

[Formula 1]

$$V_S=V_B+V_A$$

However, simply because of securing the substantial arc voltage $V_S$, in the ion source of this invention, the orientation of the arc voltage $V_A$ may be reversed from the shown example, namely, the arc voltage $V_A$ may be negative on the side of the plasma production chamber 2. In this case, the substantial arc voltage $V_S$ may be represented by the following formula. For maintaining the substantial arc voltage $V_S$ positive, $|V_B|>|V_A|$ is set up.

[Formula 2]

$$V_S=V_B-V_A$$

The main working effects by providing the positive power source 26 and the bias power source 32 are as follows:

(1) The Ion Pushing-Back Action by the Positive Electrode 26

The ion in the plasma 14 produced in the plasma production chamber 2 has the same polarity as the positive electrode 26 at the places other than the wall surfaces of the openings 26*a* to 26*c* of the positive electrode 26 by the positive voltage $V_B$ which is applied to the positive electrode 26. The ion is, therefore, pushed back toward the plasma 14 (toward the center of the plasma production chamber 2). The pushed back ion is mainly subject to collision of the primary electron 7 produced at the filament 6 and the number of charges will increase. Generally as to the ion producing possibility of the n charged ($n \geqq 2$) ion, compared to (a) the possibility to produce the n charged ion from a neutral gas, (b) the possibility to produce the n charged ion from the n−1 charged ion is far larger. According to the ion source, since the process of (b) may be efficiently utilized by use of the pushed back ion (namely what is already ionized), the multiply charged ion may be efficiently produced.

(2) Absorption of the Secondary Electron by the Positive Electrode 26

The primary electron 7 is much emitted from the filament 6 in the direction X of the magnetic field 20. The primary electron 7 is trapped by the magnetic field 20 produced in the magnetic field generator 18 and is actuated in the direction X along the magnetic field 20. In this process, the primary electron 7 comes in collision with the neutral gas and produces the plasma 14. Since the primary electron 7 has the comparatively high energy as above described, the electron 7 contributes to the production of the singly charged ion and the multiply charged ion.

In the neighborhood of the thus produced plasma 14, there is the positive electrode 26 to be applied with the positive bias voltage $V_B$ from the bias power source 32 in accordance with the ion source which is different from the known ion source. The secondary electron emitted at the time of collision of the primary electron 7 with the neutral gas has the comparatively low energy as above described and is emitted indefinitely in many directions. The secondary electron in the neighborhood of the positive electrode 26 which is located in the neighborhood of the plasma 14 is absorbed by a positive electrode 26 of different polarity. The secondary electron existing in the plasma 14 is reduced as well accordingly.

Incidentally, the primary electron 7 produced at the filament 6 has the comparatively high directivity and is trapped by the magnetic field 20 to move (in this example, the primary electron 7 moves reciprocally owing to the existence of the reflector 10) in the direction X along the magnetic field 20. Thus, the rate of the primary electron 7 absorbed by the positive electrode 26 is far smaller than the secondary electron. In order to further reduce the rate of the primary electron 7 absorbed by the positive electrode 26, it is preferred to more intensify the magnetic field 20 produced by the magnetic field producing member 18 so as to cause the magnetic field 20 to trap strongly the primary electron 7. For example, as above described, it is preferred to make the intensity of the magnetic field 20 in the plasma production chamber 2 about 10 mT to 50 mt.

Since the secondary electron has the comparatively small energy as above described, this scarcely contributes to production of the multiply charged ion, but merely contributes to production of the singly charged ion. Since the quantity of the secondary electron is reduced by the existence of the positive electrode 26, the singly charged ion produced in the plasma 14 will be so reduced. Viewing it differently, the rate of the multiply charged ion in the plasma 14 relatively increases.

With the actions of the above described (1) and (2), the rate of the multiply charged ion in the plasma 14 may be increased, and in turn, the rate of the multiply charged ion contained in the ion beam 16 may be increased. As a result, the quantity of the multiply charged ion to be extracted may be increased without increasing the whole ion beam current (the quantity of extracting the ion beam).

More specifically, a test was carried out for extracting the triply charged ion ($P^{3+}$) of phosphorus in the ion sources as shown in FIG. 1. The results are shown in Table 1. The comparative example corresponds to the known ion source without providing the positive electrode 26, because the bias voltage $V_B$ produced from the bias power source 32 was set at 0V. The example is in accordance with the invention. The substantial arc voltage $V_S$ (see Formulae 1 and 2) was the same as to both of the ion sources, because the conditions were made the same by making the densities of the plasma 14 the same as a whole. Therefore, in the example, the arc voltage $V_A$ produced from the arc power source 24 was set at 0V. In this case, the bias power source 32 also served as the normally called arc power source. With a voltage for extracting the ion beam 16 set at 40 kV and with performance made so as to make the beam current of the whole ion beam 16 the same as to the comparative example and the example, the rate of $P^{3+}$ ion contained in the ion beam 16 was measured. Further, the intensity of the magnetic field 20 was set as 24 mT as to both examples.

TABLE 1

| | Arc voltage $V_A$ [V] | Bias voltage $V_B$ [V] | Substantial arc voltage $V_S$ [V] | Ratio [%] of $P^{3+}$ ion |
|---|---|---|---|---|
| Comparative Example | 60 | 0 | 60 | 0.2 |
| Example | 0 | 60 | 60 | 0.6 |

As shown in the Table 1, irrespective of the substantial arc voltage $V_S$ and the magnetic field 20 at the same intensity, the rate of $P^{3+}$ ion is about 3 times higher in case of the example than the comparative example. It is, therefore, apparent that provision of the positive electrode 26 and application of the positive bias voltage $V_B$ remarkably contribute to increasing of the rate of multiply charged ion contained in the ion beam 16.

Figure 5:
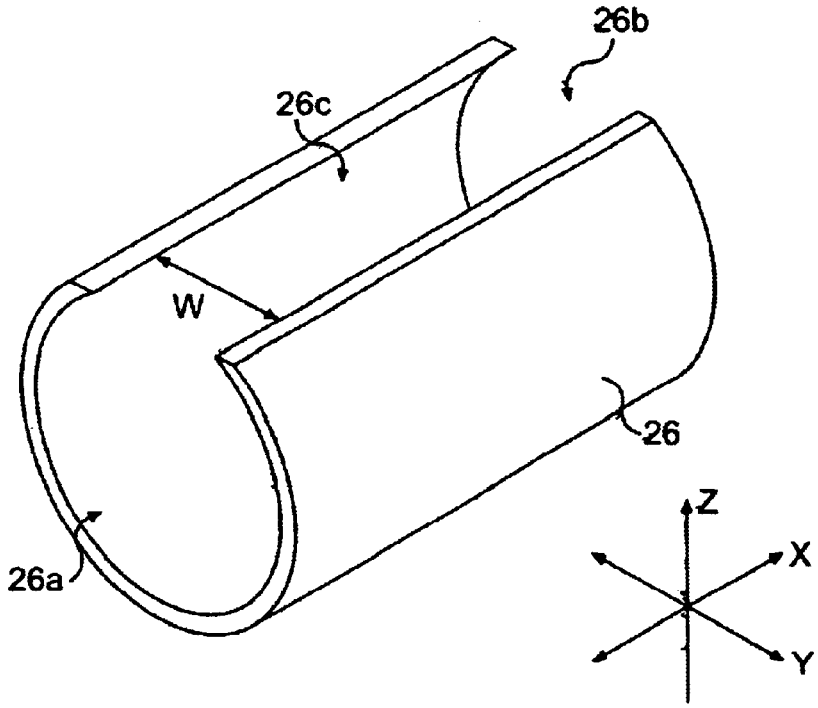
FIG. 5 is a perspective view showing another example of a positive electrode of the invention.

The shape of the positive electrode 26 may be other than that as shown in FIGS. 1 to 3. For example, as shown in FIG. 5, the positive electrode 26 may be tube or trough shaped with a circular in the cross section along the plane Y-Z. The cross section may be oval.

The opening 26*c*, 26*c*' at the side of the ion extraction opening 4 of the positive electrode 26, 26' may be all opened at the side of the ion extraction opening 4 as shown in FIGS. 1 to 3, or as shown in FIG. 5, for example, the width W of the opening 26*c*' may be made narrow. The width W of the opening 26*c*' may be made narrow to such a degree as the width of the ion extraction opening 4. Important is that the ion beam 16 may be extracted from the plasma 14 through the opening 26*c* and the ion extraction opening 4. This is a matter of importance, irrespective of the shape of the positive electrode 26. In case the width W of the opening 26*c*' is made narrow as above described, the area is increased to push back the ion, other than the ion for extracting the ion beam 16 from the plasma 14, to the side of the plasma 14 (namely, toward the center of the plasma generator 2) by the positive electrode 26, and the pushing-back action is accordingly increased. It is, therefore, apparent that the multiply charged ion producing efficiency may be increased by the ion pushing-back action of (1) as above described.

Figure 6A:
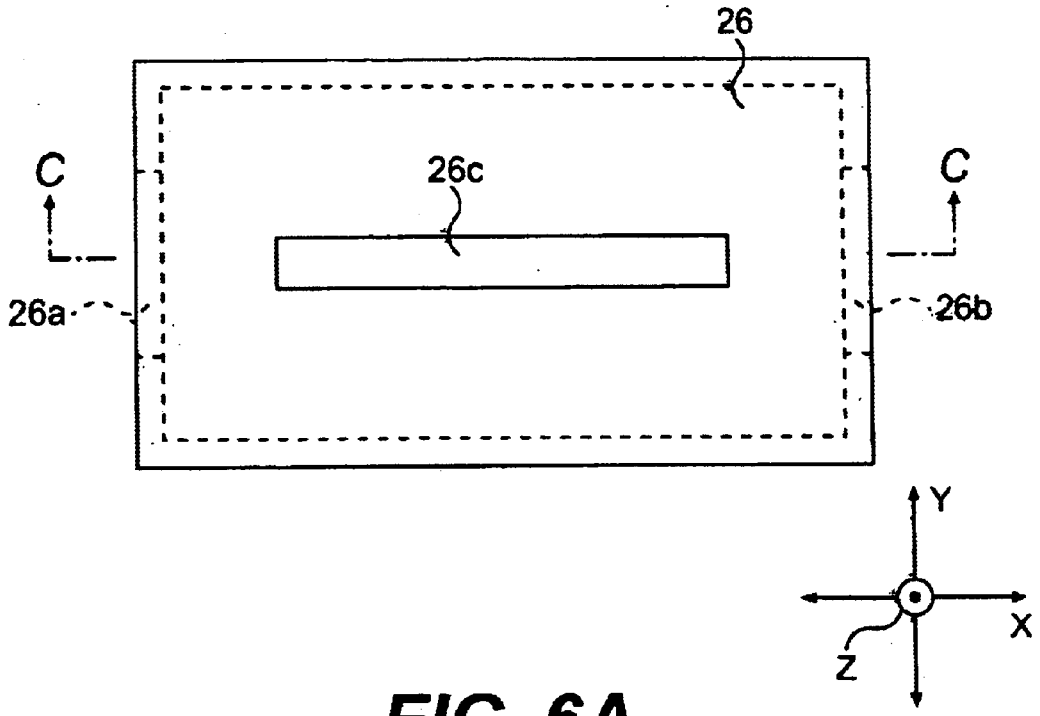
FIG. 6A is a plan view of still another embodiment of a positive electrode of the invention.
Figure 6B:
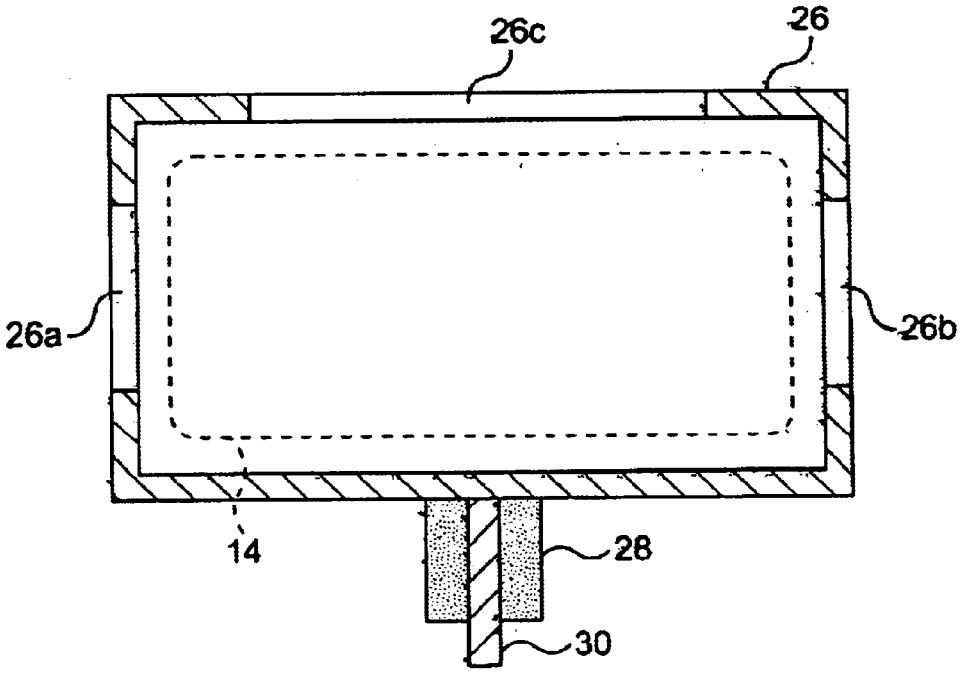
FIG. 6B is a sectional view taken along the line C—C of FIG. 6A.

Further, as shown in FIG. 6, the openings 26*a*" to 26*c*" may be formed at a part of each wall of the positive electrode 26" instead of forming the openings at the whole part of each wall of the positive electrode 26. Namely, the wall may be left around each of the openings 26*a*" to 26*c*". In this case, the size of the openings 26*a*" and 26*b*" may be sufficient to allow the primary electron 7 to reciprocally move between the filament 6 and the reflector 10. The size of the openings 26*c*" may be sufficient to make it possible to extract the ion beam 16 from the plasma 14 through the ion extraction opening 4. In this way, the area is increased to push back the ion, other than the ion for extracting the ion beam 16 from the plasma 14, to the side of the plasma 14 (namely, toward the center of the plasma production chamber 2) by the positive electrode 26, and the pushing-back action is accordingly increased. It is, therefore, apparent that the multiply charged ion producing efficiency may be increased by the ion pushing back action of (1) as above described.

Incidentally, the electron generating source for supplying the electron (primary electron) 7 for producing the plasma 14 into the plasma production chamber 2 is not limited to the structure (namely, one filament 6) as shown in FIG. 1, but other structures may be available.

For example, instead of the reflector 10, another filament of the same type as the filament 6 may be additionally used.

Further, behind each of the filaments 6, a reflector may be provided into the plasma production chamber 2, the reflector being electrically isolated from the plasma production chamber 2 and reflecting the electron released from the filament 6.

Otherwise, an electron producing source may be used having a cup like negative plate as described in Patent Laid Open 2000-90844 and a heater (filament) for heating the same to release electron.

Alternatively, an electron producing source as described in Patent Laid Open 35650/1997 may be used, where the plasma is produced in a small plasma production chamber, and the electron is extracted from the plasma and is supplied into the plasma production chamber 2.

According to the invention, the positive electrode and the bias power source are provided to push back the ion in the plasma by the positive electrode and to suck the secondary electron in the plasma by the positive electrode. With the both actions, the rate of multiply charged ion in the plasma may be increased and accordingly the rate of multiply charged ion contained in ion beam may be increased. As a result, the multiply charged ion extraction quantity may be increased without increasing the whole ion beam current.

What is claimed is:

1. An ion source comprising:

a plasma production chamber having a gas introduction portion for introducing a gas into the plasma production chamber, and an ion extraction opening for extracting ion beam thereat;

an electron producing source for supplying electron into the plasma production chamber to ionize the gas by electronic collision, thereby to produce plasma;

a magnetic field generator for producing a magnetic field for confining the electron produced at the electron producing source within the plasma production chamber;

a positive electrode provided in the plasma production chamber and electrically isolated therefrom, and having three openings formed at least at both sides in a direction along the magnetic field and at a side of the ion extraction opening; and a direct current bias power source for applying bias voltage to the positive electrode, the bias voltage being positive against the plasma production chamber.

2. The ion source according to claim 1, wherein the positive electrode is tube, box or trough shaped with a square in cross section along a plane crossing with the direction along the magnetic field.

3. The ion source according to claim 1, wherein the positive electrode is tube or trough shaped with a circular or oval in the cross section along a plane crossing with the direction along the magnetic field.

4. The ion source according to claim 2, wherein the positive electrode is the box with three openings formed at the whole part of each side of the positive electrode.

5. The ion source according to claim 2, wherein the positive electrode is the box with three openings formed at a part of each side of the positive electrode.

6. The ion source according to claim 3, wherein the positive electrode is tube shaped with the circular in cross section, and a width in a direction crossing with the direction along the magnetic field of the opening at the side of the ion extraction opening is equal to more than a width in a direction crossing with the direction along the magnetic field of the ion extraction opening.

* * * * *